US010808360B2

(12) United States Patent
Anzel et al.

(10) Patent No.: US 10,808,360 B2
(45) Date of Patent: Oct. 20, 2020

(54) METHOD FOR PRODUCING A FIBROUS MATERIAL WEB

(71) Applicant: Andritz AG, Graz (AT)

(72) Inventors: Andreas Anzel, Graz (AT); Klaus Gissing, Judendorf-Straßengel (AT); Thomas Scherb, Sao Paulo (BR)

(73) Assignee: Andritz AG, Graz (AT)

( * ) Notice: Subject to any disclaimer, the term of this patent is extended or adjusted under 35 U.S.C. 154(b) by 90 days.

(21) Appl. No.: 15/764,593

(22) PCT Filed: Sep. 15, 2016

(86) PCT No.: PCT/EP2016/071818
§ 371 (c)(1),
(2) Date: Jul. 10, 2018

(87) PCT Pub. No.: WO2017/060053
PCT Pub. Date: Apr. 13, 2017

(65) Prior Publication Data

US 2019/0360155 A1 Nov. 28, 2019

(30) Foreign Application Priority Data

Oct. 6, 2015 (AT) ..... A 50853/2015

(51) Int. Cl.

| | |
|---|---|
| ***D21F 11/14*** | (2006.01) |
| ***D21F 1/02*** | (2006.01) |
| ***D21F 1/76*** | (2006.01) |
| ***D21F 1/78*** | (2006.01) |
| ***D21F 7/08*** | (2006.01) |
| ***D21F 9/00*** | (2006.01) |
| ***D21H 27/00*** | (2006.01) |

(52) U.S. Cl.
CPC ..... *D21F 11/14* (2013.01); *D21F 1/02* (2013.01); *D21F 1/76* (2013.01); *D21F 1/78* (2013.01); *D21F 7/083* (2013.01); *D21F 9/003* (2013.01); *D21H 27/002* (2013.01)

(58) Field of Classification Search
USPC ..... 162/217
See application file for complete search history.

(56) References Cited

U.S. PATENT DOCUMENTS

| | | | | |
|---|---|---|---|---|
| 3,224,928 | A | 12/1965 | Lee et al. | |
| 4,055,461 | A * | 10/1977 | Turunen | D21F 11/14 162/290 |
| 6,231,723 | B1 * | 5/2001 | Kanitz | D21F 3/0272 162/111 |
| 6,841,037 | B2 * | 1/2005 | Scherb | D21F 1/0027 139/383 A |
| 2005/0167061 | A1 * | 8/2005 | Scherb | D21F 1/0036 162/115 |
| 2007/0215304 | A1 | 9/2007 | Lippi Alves Fernandes et al. | |
| 2015/0167242 | A1 | 6/2015 | Silva et al. | |
| 2017/0096775 | A1 * | 4/2017 | Anzel | D21F 1/76 |

FOREIGN PATENT DOCUMENTS

| | | | |
|---|---|---|---|
| WO | 2001000925 | A1 | 1/2001 |
| WO | 2009063396 | A1 | 5/2009 |

OTHER PUBLICATIONS

International Search Report dated Sep. 15, 2016 (PCT/EP2016/071818).

* cited by examiner

*Primary Examiner* — Mark Halpern
(74) *Attorney, Agent, or Firm* — Alix, Yale & Ristas, LLP

(57) ABSTRACT

A method for producing a fibrous material web, particularly for producing a tissue or hygienic paper web, in which a fibrous suspension is dewatered in a crescent former to obtain a fibrous material web, and dried on a Yankee. After the crescent former, the fibrous material web is guided along with the forming screen and felt over a suction roller downstream of the forming roller. A device for carrying out the method for producing a fibrous material web.

16 Claims, 1 Drawing Sheet

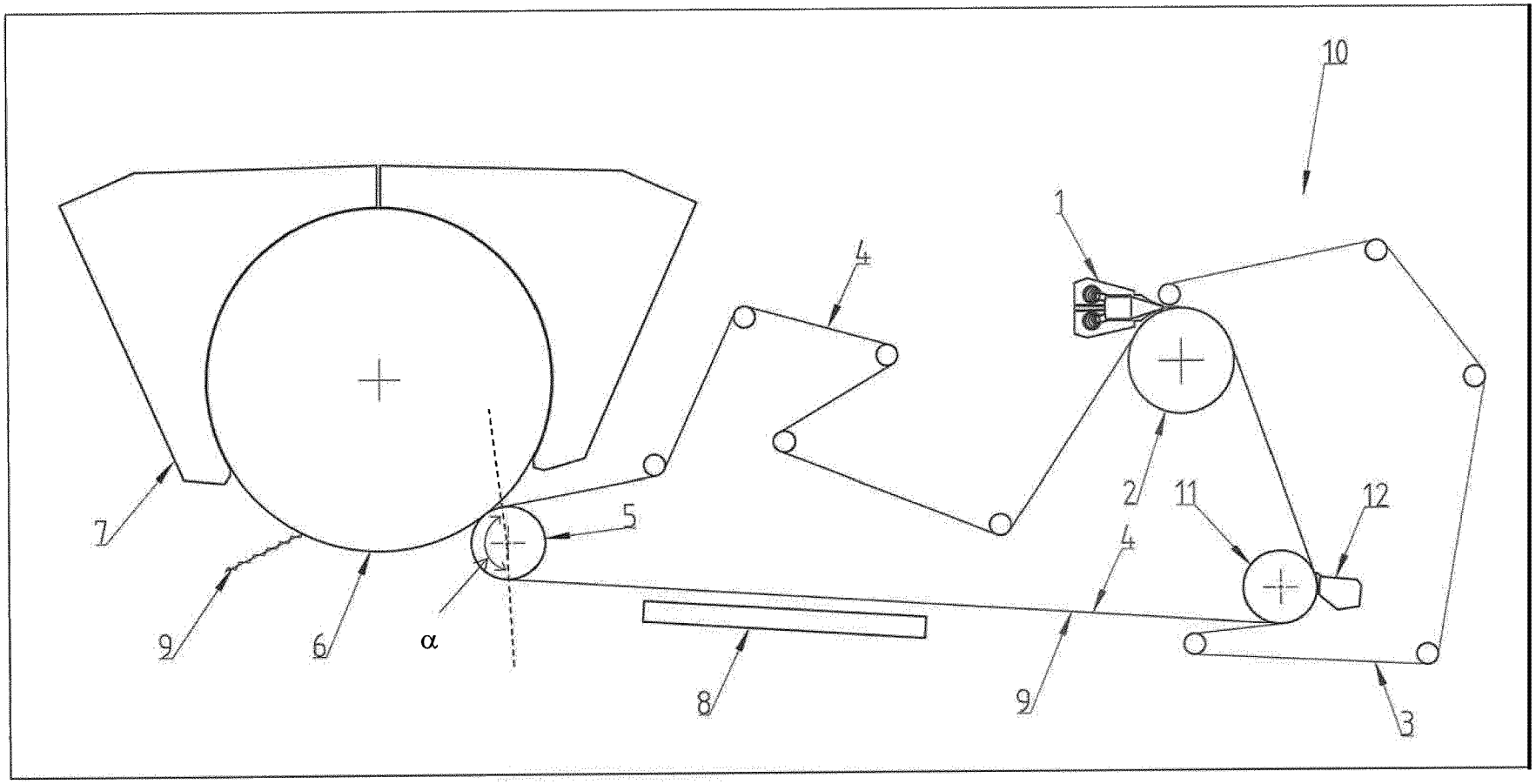
10
1
2
3
4
4
5
6
7
8
9
9
11
12
α

METHOD FOR PRODUCING A FIBROUS MATERIAL WEB

This application is a 371 of PCT/EP2016/071818 filed on 15 Sept. 2016.

BACKGROUND

The subject of this invention is a method for producing a fibrous pulp web, in particular a tissue or sanitary paper web. With this method, a fibrous pulp suspension is dewatered in a Crescent former in order to form a fibrous pulp web and then dried with the aid of a Yankee. In the Crescent former, the fibrous pulp suspension is fed through a headbox and in between a forming wire and a felt, where it is dewatered by centrifugal force in the area of a forming roll. A device that can perform the process according to the invention is also the subject of the present invention.

High-quality paper is produced traditionally on TAD machines. These machines are able to produce very good product quality, but they are very expensive to buy, and the specific energy costs are also much higher than in conventional dry-crepe machines with a Yankee.

In conventional tissue machines with Crescent formers, i.e. with forming units in which the fibrous pulp suspension is fed in between a felt and a wire at a forming roll, the fibrous pulp web is dewatered to a dryness of approximately 10% by the centrifugal forces occurring at the forming roll. Subsequently, the fibrous pulp web is carried onwards on the felt, dewatered by vacuum to a dryness of approximately 20% to 23%, and finally pressed mechanically because no further dewatering by vacuum is possible on the wet felt. The dryness increased to approximately 40% in this process. It is followed by thermal drying on the Yankee.

Pressing of the fibrous pulp web in a press section has a negative impact on the quality of the tissue web. The paper web, which is still damp, loses bulk as a result of being pressed. However, pressing is often necessary in order to obtain the necessary dryness content before the web can be transferred to the Yankee.

DE 10 2011 007 568 A1 describes a tissue machine in which the fibrous pulp web is guided over a suction roll with a permeable pressing belt wrapped round it before the web reaches the Yankee. The pressing belt does not compress the fibrous pulp web as much as conventional presses, however there are substantial losses of quality in this process.

U.S. Pat. No. 3,224,928 discloses a paper machine having a Crescent former with a forming roll, where a suction roll over which the fibrous pulp web is guided together with the felt and the wire is arranged directly after the forming roll.

EP 1 837 439 A2 describes Voith's ATMOS system. This is a system in which the fibrous pulp web is dewatered with the aid of a permeable pressing belt. EP 1 837 439 A2 relates in particular to the structure of the pressing belt.

WO 01/00925 describes a machine and a method for production of tissue, where an impingement dryer is arranged ahead of the Yankee.

Among the disclosures in WO 2009/063396 A1 is a tissue machine that is equipped with only two fabrics, a wire and a felt.

The herein disclosure provides an inventive process for tissue production in which the highest possible quality of tissue can be produced.

According to the invention, the fibrous pulp web is guided over a suction roll together with the forming wire and the felt immediately after the forming roll and further dewatered there.

There are no pressing belts in the area of the suction roll. Instead, the fibrous pulp web is only enclosed by the forming wire and the felt, and gentle dewatering is possible as a result. According to the invention, the felt is between suction roll and fibrous pulp web, and the forming wire is wrapped round the fibrous pulp web on the outside. Thus, gentle pressing force can be applied to the fibrous pulp web via the forming wire, however the tensile stress of the forming wire should be less than 15 kN/m in the area of the suction roll, preferably less than 12 kN/m.

At the suction roll, preferably a hot fluid flows through the fibrous pulp web, for example hot air at a temperature of more than 150° C., in particular more than 200° C., preferably more than 250° C.

The humidity of the hot air applied via the hood should preferably be more than 150 g $H_2O$/kg air, in particular more than 300 g $H_2O$/kg air, preferably even more than 450 g $H_2O$/kg air. The hot air applied should preferably be the exhaust air from the Yankee hood.

It is favourable if the steam flows through the felt, the fibrous pulp web and the forming wire in the first part of the suction roll, i.e. in the area in which the fibrous pulp web comes into contact with the suction roll. This increases the temperature of the fibrous pulp web further, the viscosity of the water drops, and vacuum dewatering is improved. The suction roll or the suction roll hood can also be sub-divided in machine direction into several zones, for example into two zones. In this way, dewatering in the first zone can be conducted at other operating parameters, for example higher pressure, higher temperature, or with a different medium.

It is an advantage if the fibrous pulp web is then transported on the felt to the Yankee and transferred there to the surface of the Yankee via a press or, preferably, a shoe press. The entire machine then only needs two fabrics—the forming wire and the felt.

It is favourable if the fibrous pulp web is transferred to the Yankee with the aid of a shoe press roll, preferably with an angle of wrap by the felt of more than 60°, preferably more than 90°, ideally more than 120°. As a result, the deflection roll currently used underneath the shoe press roll can be omitted.

Compared to conventional machines, the dryness after the forming unit is not just 10%, but more than 20%, especially more than 25%, preferably more than 30%. There is still enough space available between the forming unit and the Yankee for further units. Thus, an additional drying step can be performed there, for example with an impingement or radiation dryer (e.g. infra-red radiator). The dryness afterwards is then more than 25%, especially more than 30%, preferably more than 35%.

The advantage is that the fibrous pulp web reaches the press at the Yankee with a dryness of more than 30% instead of only the 20% to 23% in conventional plants. With this higher dryness, the fibers are more resistant to mechanical pressing. This provides greater bulk after the press.

It is favourable if the felt has a fine-pored structure, where the average pore size of the felt surface facing the fibrous pulp web is smaller than the average pore size of the side facing the suction roll. If the top side of the felt facing the fibrous pulp web is fine and soft, this increases the contact area between the felt and the fibrous pulp web, which enhances capillary dewatering. On the other hand, a coarser felt structure towards the suction roll facilitates water drainage through the perforated suction roll surface to the inside of the roll. The fineness of the finer felt surface should be less than 6.7 dtex, preferably less than 3.3 dtex, and the layer directly beneath it should have a fineness of less than 17 dtex, preferably less than 11 dtex, whereas the opposite side of the felt facing the suction roll is then much more open to facilitate water drainage through the bore holes in the suction roll. These dtex values relate to the basic fiber fraction in the felt.

It is also feasible to lift the forming wire up and off the fibrous pulp web after the forming roll, dry the wire and then place is back in contact with the fibrous pulp web again ahead of the suction roll.

BRIEF DESCRIPTION OF THE DRAWINGS

FIG. 1 shows a representation of the disclosed method and device.

DETAILED DESCRIPTION

In the following, an embodiment of the invention is described on the basis of FIG. 1.

In FIG. 1, the fibrous pulp suspension is fed through a headbox 1 in between a felt 4 and a forming wire 3 at a forming roll 2 in a Crescent former 10.

The felt 4 and the forming wire 3 are wrapped round a part of the outer circumference of the forming roll 2, so that the water in the fibrous pulp suspension is thrown outwards through the forming wire by the centrifugal forces. Here, the felt is on the inside. After the forming roll 2, the dryness of the fibrous pulp web 9 is approximately 10%.

Following this centrifugal dewatering, the felt 4, the fibrous pulp web 9 and the forming wire 3 are guided over a suction roll 11 around which they are wrapped in places. The suction roll 2 draws the moisture out of the fibrous pulp web 9 and through the felt 4 by suction in a vacuum dewatering process.

In order to improve dewatering, a steam blow box 12 is mounted in the first wrapped area of the suction roll 11. Hot steam flows through this steam blow box onto the fibrous pulp web 9 and heats it in this way. After the suction roll 11, the fibrous pulp web 9 has approximately 25% to 30% dryness. As the fibrous pulp web 9 is still very damp in the area of the suction roll 11, there is very little evaporation here. On the contrary, the heat supply reduces the viscosity of the water in the fibrous pulp web 9, which causes the water to be sucked out of the fibrous pulp web 9 through the suction roll 11. The fine-pored felt 4 enhances the dewatering process through capillary dewatering.

After the suction roll 11, the forming wire 3 is lifted off the fibrous pulp web 9. In the present example, this is followed by impingement drying 8. Radiation drying (e.g. infra-red radiation) would also be feasible. Here, the impingement dryer 8 is arranged on the side of the fibrous pulp web 9. The fibrous pulp web has approximately 30% to 35% dryness. Finally, the fibrous pulp web 9 is transferred from the felt 4 to a Yankee 6 by means of a shoe press roll 5. In the present embodiment, the felt 4 is wrapped round the shoe press roll 5 with an angle of wrap ($\alpha$) of ~175°. At the Yankee 6, the fibrous pulp web 9 is dried by the hot air applied through the Yankee hood 7 in a way that is known and then scraped off. The dryness of the fibrous pulp web 9 when transferred to the Yankee 6 is approximately 50%.

The invention claimed is:

1. A method for production of a fibrous pulp web (9), comprising:

in a Crescent former (10), feeding a fibrous pulp suspension through a headbox (1) between a forming wire (3) and a felt (4) to dewater the fibrous pulp suspension by centrifugal force in the area of a forming roll (2) to form a fibrous pulp web (9), guiding the fibrous pulp web (9) over a suction roll (11) together with the forming wire (3) and the felt (4) directly after the forming roll (2) to dry the fibrous pulp web (9) with the aid of a Yankee (6), wherein the felt (4) is between the suction roll (11) and the fibrous pulp web (9) and the forming wire (3) is wrapped around the fibrous pulp web (9) on the outside.

2. The method of claim 1, wherein the fibrous pulp web (9) is wrapped round the suction roll (11) in places and a hot fluid flows through the fibrous pulp web (9) on the suction roll (11).

3. The method of claim 2, wherein the hot fluid is air at a temperature of more than 150° C.

4. The method of claim 3, wherein the air flowing through the fibrous pulp web (9) has a moisture content of more than 150 g $H_2O$/kg air.

5. The method of claim 3, wherein the air is exhaust air from a Yankee hood (7).

6. The method of claim 5, wherein the felt has multiple layers, including a first layer defining a first surface facing the fibrous pulp web having a first average fineness that is less than 6.7 dtex, a second layer directly beneath the first layer having a second average fineness that is less than 17 dtex, and a third layer defining a third surface facing the suction roll having a third average fineness that is greater than 17 dtex.

7. The method of claim 3, wherein the felt has multiple layers, including a first layer defining a first surface facing the fibrous pulp web having a first average fineness that is less than 6.7 dtex, a second layer directly beneath the first layer having a second average fineness that is less than 17 dtex, and a third layer defining a third surface facing the suction roll having a third average fineness that is greater than 17 dtex.

8. The method of claim 2, wherein steam flows through the fibrous pulp web (9) in an initial section of the suction roll (11).

9. The method of claim 1, wherein the fibrous pulp web (9) is conveyed to the Yankee (6) on the felt (4).

10. The method of claim 9, wherein the fibrous pulp web (9) is transferred to the Yankee (6) with the aid of a shoe press roll (5), and the felt is wrapped around the shoe press roll (5) at an angle of more than 60°.

11. The method of claim 10, wherein the felt is wrapped around the shoe press roll (5) at an angle of more than 90°.

12. The method of claim 1, wherein the felt has multiple layers, including a first layer defining a first surface facing the fibrous pulp web having a first average fineness, a second layer directly beneath the first layer having a second average fineness that is greater than the first average fineness, and a third layer defining a third surface facing the suction roll having a third average fineness that is greater than the second average fineness.

13. The method of claim 1, wherein the felt has multiple layers, including a first layer defining a first surface facing the fibrous pulp web having a first average fineness that is less than 6.7 dtex, a second layer directly beneath the first layer having a second average fineness that is less than 17 dtex, and a third layer defining a third surface facing the suction roll having a third average fineness that is greater than 17 dtex.

14. The method of claim 1, wherein the fibrous pulp web (9) is pre-dried by an impingement dryer (8) before the Yankee (6) and after the suction roll (11).

15. A method for production of a fibrous pulp web (9), comprising:

feeding a fibrous pulp suspension through a headbox (1) between a forming wire (3) and a felt (4) to dewater the fibrous pulp suspension by centrifugal force in the area of a forming roll (2) to form a fibrous pulp web (9), guiding the fibrous pulp web (9) over a suction roll (11) together with the forming wire (3) and the felt (4) directly after the forming roll (2) to dry the fibrous pulp web (9), wherein the felt (4) is between the suction roll (11) and the fibrous pulp web (9) and the forming wire (3) is wrapped around the fibrous pulp web (9) on the outside, the fibrous pulp web (9) is wrapped round the suction roll (11) in places and a moist air having a temperature greater than 150° C. and moisture content of more than 150 g $H_2O$/kg air flows through the fibrous pulp web (9) on the suction roll (11).

16. The method of claim 15, comprising a Yankee (6) aids the step of guiding the fibrous pulp web (9) and the moist air is exhaust from a Yankee hood (7).

* * * * *